US005230554A

United States Patent [19]

Camilleri

[11] Patent Number: 5,230,554

[45] Date of Patent: Jul. 27, 1993

[54] SLIDING STORAGE BASKET

[75] Inventor: Charles Camilleri, St. Louis, Mo.

[73] Assignee: Lee/Rowan Company, St. Louis, Mo.

[21] Appl. No.: 674,135

[22] Filed: Mar. 25, 1991

[51] Int. Cl.[5] ..... A47B 88/00

[52] U.S. Cl. ..... 312/334.6; 312/334.44; 312/334.31

[58] Field of Search ..... 312/408, 344.1, 343, 312/346, 347, 348, 349, 350

[56] References Cited

U.S. PATENT DOCUMENTS

| | | | |
|---|---|---|---|
| 664,755 | 12/1800 | Hunter . | |
| 1,786,045 | 12/1930 | Vogt | 312/346 |
| 1,816,213 | 7/1931 | Duke . | |
| 2,005,938 | 6/1935 | Graves . | |
| 2,796,309 | 6/1957 | Taylor . | |
| 3,679,274 | 7/1972 | Nance . | |
| 3,922,046 | 11/1975 | Schneider . | |
| 3,973,814 | 8/1976 | Entrikin . | |
| 4,723,743 | 2/1988 | Jenkins . | |

FOREIGN PATENT DOCUMENTS

| | | | |
|---|---|---|---|
| 0737884 | 12/1932 | France | 312/346 |

*Primary Examiner*—Kenneth J. Dorner
*Assistant Examiner*—Gerald A. Anderson
*Attorney, Agent, or Firm*—Rogers, Howell & Haferkamp

[57] ABSTRACT

A sliding storage container apparatus is provided that is comprised of a storage container having a pair of laterally spaced and longitudinally extending rails secured to its underside, and a pair of tracks that engage the rails in sliding engagement. The tracks are mounted in a laterally spaced longitudinally extending disposition on a flat horizontal base surface and the container is mounted for sliding fore and aft movement on the tracks. The tracks or rails are provided with fore and aft stop abutments that limit the extent to which the container may slide over the tracks, and the container rails are provided with slots dimensioned to enable the rails and the container to be disengaged from the track by elevating or leveling the rails and container and sliding the rails and container forward over the fore track abutments.

11 Claims, 3 Drawing Sheets

SLIDING STORAGE BASKET

BACKGROUND OF THE INVENTION (1) Field of the Invention

The present invention relates to a sliding storage basket assembly. In particular, the present invention relates to a sliding storage basket assembly that is generally comprised of three parts that are inexpensive to manufacture and are easily assembly to a flat horizontal surface. The assembly permits the storage basket to slide forward and backward a limited distance, and also enables the removal of the storage basket from its mounting to the horizontal surface.

(2) Description of the Related Art

Cabinet type storage enclosures having deep volumes and shelving storage systems employing shelves having large depths are two examples of storage assemblies that provide large storage surface areas. The large storage surface areas of these assemblies not only permit objects to be placed side by side on the surface areas, but also permit objects to be placed one behind another on the surface areas.

However, these types of storage assemblies have been found to be disadvantaged in that it is often difficult for a person to reach past objects stored at the front of the assemblies and get at objects stored in the back of the cabinets or shelves. This often results in only the forward areas of the cabinets or shelves being used as storage surfaces, and the back areas of these cabinets and shelves are left bare and unused.

The present invention solves this space utilization problem by providing a slidable storage basket assembly that is mountable to a flat horizontal surface. The assembly includes a basket container that is slidable forward and backward over the surface to which the assembly is mounted. The sliding movement of the basket enables objects stored at the back of the basket to be reached easily by sliding the basket forward, or by completely removing the basket from its sliding mount to the surface.

SUMMARY OF THE INVENTION

The sliding storage basket assembly of the present invention is generally comprised of a storage basket and a pair of tracks that support the basket for sliding movement fore and aft. The three component parts of the invention are inexpensive to manufacture and are easily assembled to a horizontal base surface of a cabinet enclosure or shelving system. The simplified construction of the sliding storage basket assembly enables any lay person to mount the pair of tracks to a horizontal base surface of a cabinet or shelving system, and then assemble the basket container to the tracks for fore and aft sliding movement of the basket on the base surface.

The basket container is a wire basket having a box-like configuration with an open top. A pair of rails are secured to the underside of the basket bottom. The rails extend parallel and longitudinally across the underside of the basket. Each of the rails has a general C-shape in cross section and the interior of the C-shape forms a slot in the rails that extends along their entire longitudinal length.

The pair of tracks are secured to a horizontal base surface on which the sliding basket is desired to be mounted. Each of the tracks is formed with a flange that is elevated slightly above the base surface on which the tracks are mounted. The flanges extend the entire longitudinal length of the tracks. Each of the track flanges is dimensioned to be received in the slots in the rails secured to the underside of the basket bottom. The engagement of the flanges in the rail slots provides a sliding connection between the rails and tracks that enables sliding movement of the container basket fore and aft over the base surface.

Fore and aft stops are provided at the opposite ends of each track. The opposite ends of the rails secured to the container basket engage the fore and aft stops at the furthest extent of their forward and backward sliding movement over the tracks. Engagement of the rails with the fore and aft stops prevents the container basket from sliding further forward or backward over the tracks.

The slots provided in the container basket rails have a width dimensioned to enable the basket and rails to be elevated slightly relative to the tracks. Elevating the basket and the rails enables the opposite fore and aft ends of the rails to pass over the stops provided at the opposite ends of the tracks. This enables the container basket rails to slide further forward past the fore stops of the tracks to completely remove the basket from the pair of tracks.

In a further embodiment of the invention, the pair of rails secured to the container bottom are slightly more than twice as long as the pair of tracks secured to the horizontal base surface. Fore and aft stops are provided at the opposite ends of each rail. The opposite ends of the tracks, secured to the horizontal base surface, engage the fore and aft stops on the rails at the furthest extent of the backward and forward sliding movement of the rails over the tracks. Engagement of the track ends with the fore and aft stops of the rails prevents the container basket from sliding further backward or forward over the tracks.

The fore and aft stops on the opposite ends of the rails extend upward into lower portions of the rail slots. The rail slots have a vertical width dimensioned large enough to allow some relative vertical movement between the pair of rails and the pair of tracks. By pulling the container forward, the forward ends of the container and rails pivot downward slightly on the tracks. The downward pivoting movement of the forward ends of the rails causes the rail aft stop abutments to move upward relative to the tracks and engage the aft ends of the tracks. In a similar manner, moving the container basket backward over the tracks causes the rearward ends of the container basket and rails to pivot downward slightly relative to the tracks. This pivoting movement causes the rail fore stop abutments to move upward. The upward movement of the rail fore stop abutments causes them to engage the fore ends of the tracks as the container basket is moved backward and stop any further backward movement of the container basket.

By holding the container basket and rails level relative to the pair of tracks, the fore and aft stop abutments of the rails are prevented from engaging the fore and aft ends of the pair of tracks. With the basket and rails held level relative to the tracks as the basket is moved forward, the basket can be removed from the pair of tracks.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
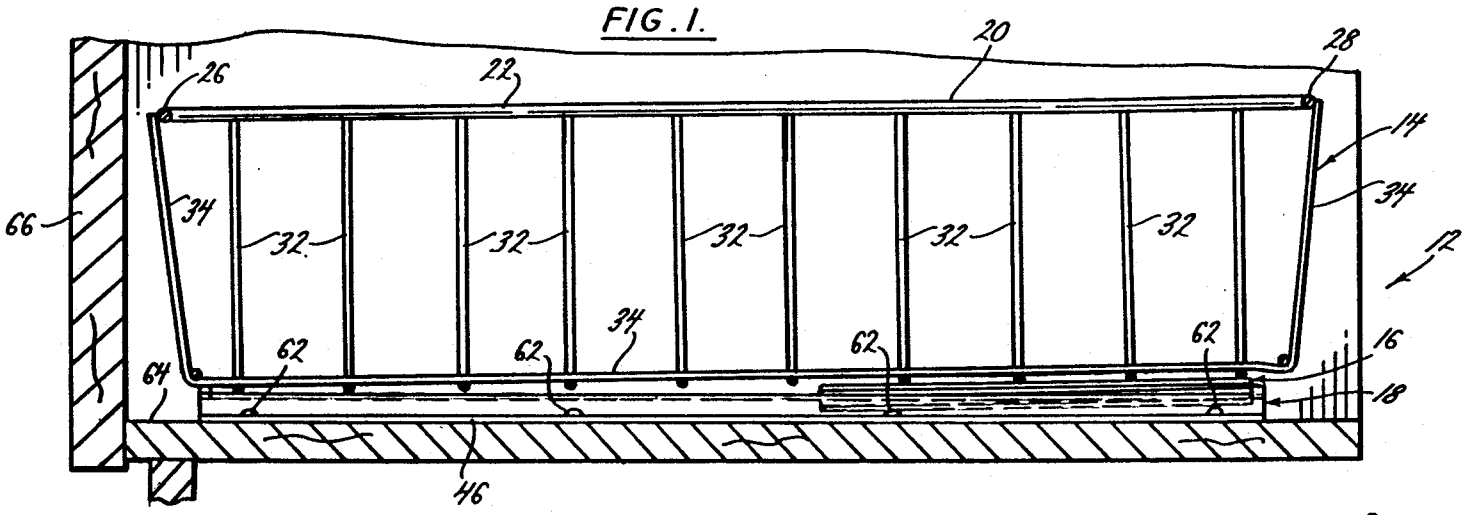
FIG. 1 is an elevation view of the sliding storage basket assembly of the invention mounted in a cabinet enclosure.
Figure 2:
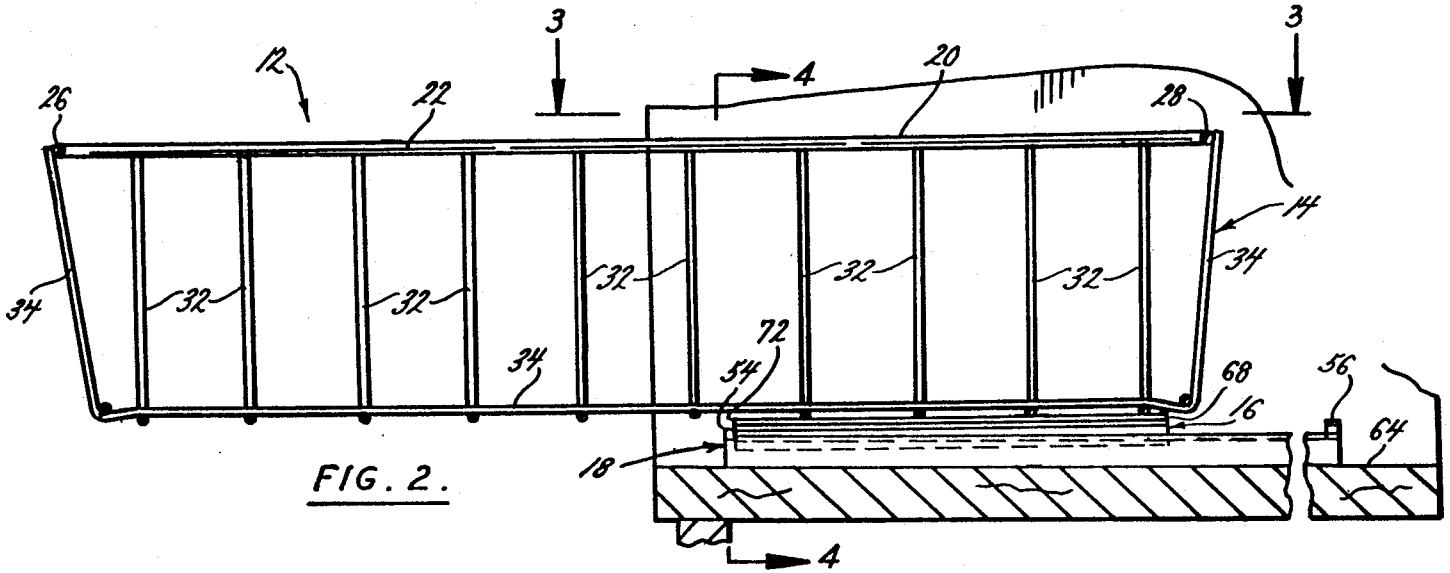
FIG. 2 is an elevation view of the sliding storage basket assembly of FIG. 1 shown with the container basket of the assembly extended from the cabinet enclosure.
Figure 3:
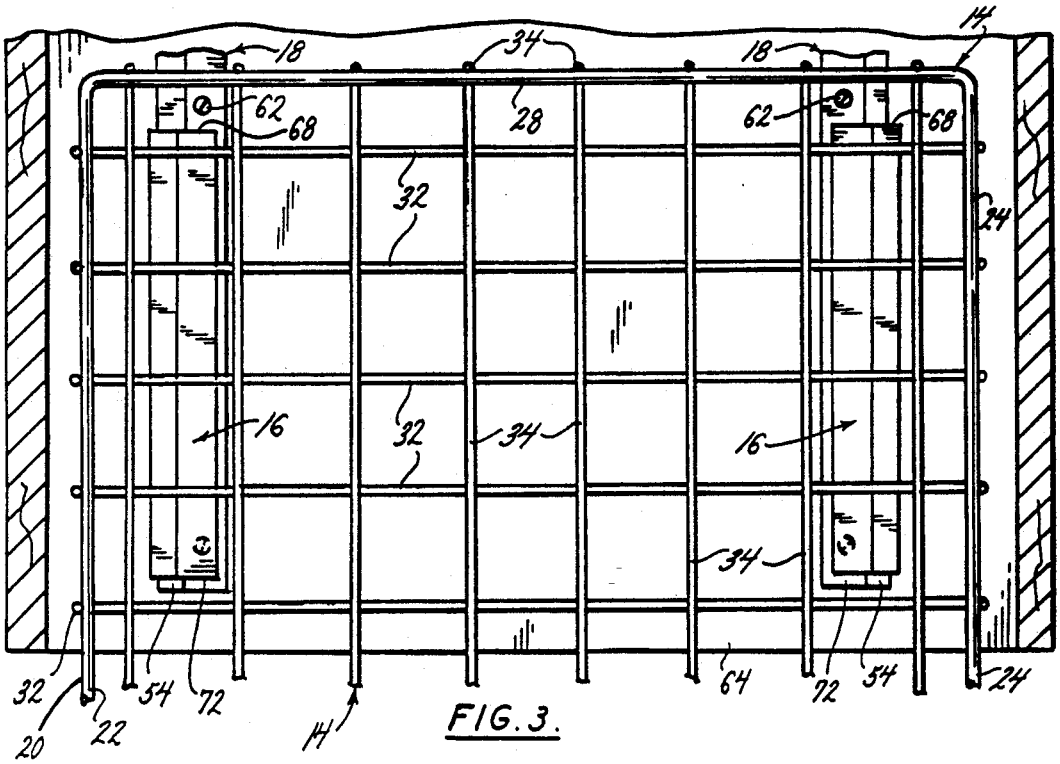
FIG. 3 is a segmented plan view of the sliding storage basket assembly taken along the line 3—3 of FIG. 2.

The sliding storage basket assembly 12 of the present invention is shown in FIGS. 1 and 2 of the drawing figures. The apparatus is generally comprised of a wire basket container 14, a pair of rails 16 secured to an underside of the basket, and a pair of tracks 18 that slidingly engage with the rails and are mounted on a horizontal base surface.

The wire basket container 14 includes a rectangular peripheral wire loop 20 at the top of the container. The loop is comprised of left and right sections 22, 24 and front and back sections 26, 28. A plurality of wires 32 extend vertically downward from the left and right sections 22, 24 of the loop, and then extend horizontally across the bottom of the basket container 14. A second plurality of wires 34 extend vertically downward from the front and back sections 26, 28 of the wire loop, and then extend horizontally across the bottom of the basket container 14. The first and second pluralities of wires 32, 34 crisscross each other and are secured together at the bottom of the basket container 14. Together, the first and second pluralities of wires 32, 34 form the container basket bottom.

Figure 5:
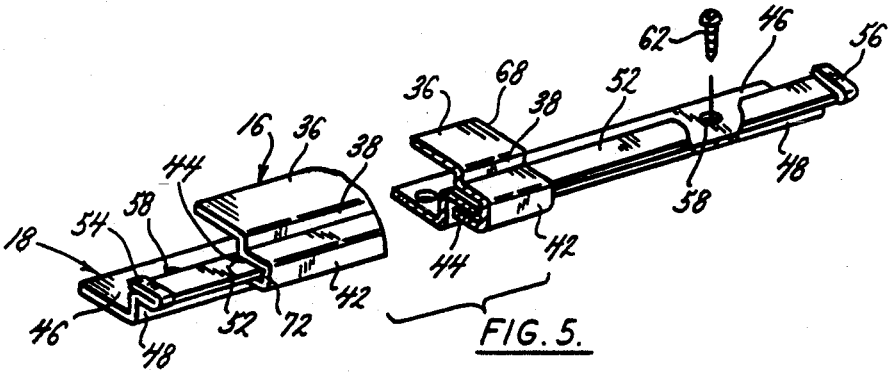
FIG. 5 is segmented perspective view of one track and one rail of the sliding storage basket assembly of the invention.

The pair of rails 16 secured to the underside of the basket container bottom are substantially identical and are mirror images of each other. As is best seen in FIG. 5, each rail 16 is formed with a flat horizontal top section 36 that extends the entire longitudinal length of the rail. The top section 36 of each rail is secured to the underside of the crisscrossing pluralities of wires 32, 34 that form the basket container bottom. Each of the rails also includes a vertical section 38 that depends downward from a lateral edge of the top section 36. The vertical section 38 also extends along the entire longitudinal length of the rail. At the bottom most edge of the vertical section 38, the rail is formed in a C-shaped section 42. The interior of the C-shaped section 42 forms a slot 44 that, together with the C-shaped section 42, extends the entire longitudinal length of the rail 16.

Figure 4:
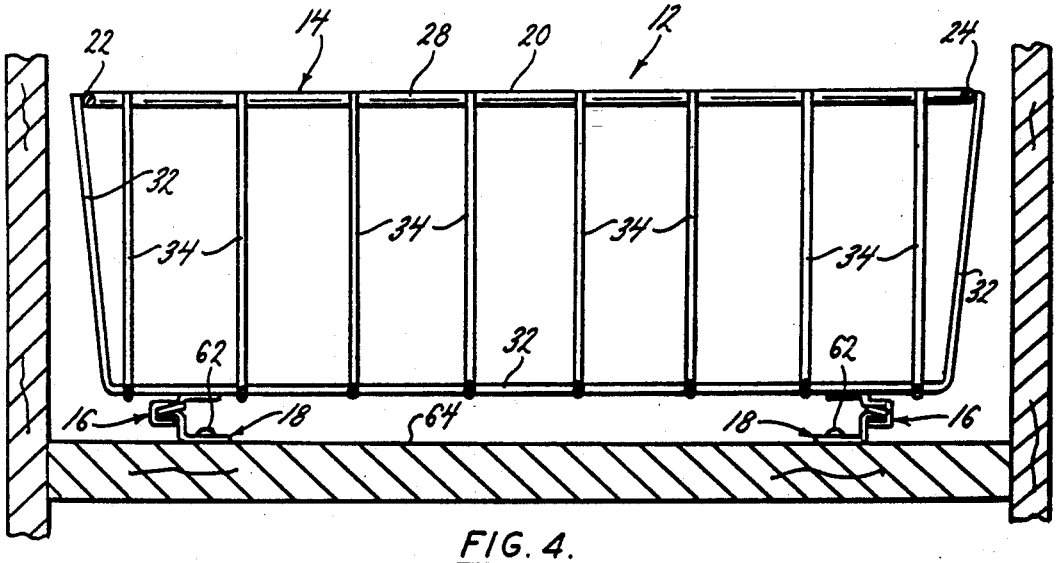
FIG. 4 is a segmented front elevation view of the sliding storage basket assembly taken along the line 4—4 of FIG. 2.

As seen in FIGS. 1 and 2, the longitudinal length of the rails 16 is slightly less than one-half the longitudinal length of the basket container 14. This length provides ample support for the basket container 14 and enables slightly more than half of the basket container 14 to extend beyond the forward most ends of the tracks 18 when the basket is moved forward its furthest extent on the tracks. As is best seen in FIG. 4, the pair of rails 16 are secured to the underside of the basket container 14 with the rails being laterally spaced from each other. The rails extend parallel and longitudinally across the bottom of the basket container and the slots 44 of each rail face each other. Alternatively, the rails could be secured to the bottom of the basket container with the slots 44 facing away from each other (not shown). Of course, the positions of the tracks 18 will also have to be altered.

The pair of tracks 18 are substantially identical to each other. One track 18 of the pair of tracks is shown in FIG. 5. Each track is formed with a bottom horizontal section 46 that extends the entire longitudinal length of the track. A vertical section 48 extends upward from a lateral side edge of the bottom section 46. Like the bottom section, the vertical section 48 extends the entire longitudinal length of the track. A flange section 52 is formed along the top most edge of the vertical section 48. The flange section 52 projects laterally from the top edge of the vertical section 48 and extends the entire longitudinal length of the track 18. Fore and aft stop abutments 54, 56 are formed at the opposite fore and aft ends of the flange, respectively. The fore and aft stop abutments 54, 56 limit the sliding movement of the rails 16 over the tracks 18 in a manner to be described. Pluralities of holes 58 are provided through the bottom horizontal sections 46 of the tracks. The holes 58 are provided to receive threaded fasteners such as wood screws 62 or other equivalent types of fasteners to secure the pair of tracks 18 to a flat horizontal base surface.

The sliding storage basket assembly 12 of the present invention is mounted to a flat horizontal base surface 64 with the component parts of the assembly relatively positioned as shown in drawing FIGS. 1–4. The drawing figures show the assembly of the invention 12 mounted inside a cabinet enclosure behind a door 66 of the cabinet. The apparatus of the invention is shown in this environment for illustrative purposes only and it should be understood that the operative environment of the invention to be described is not intended to be limiting.

In mounting the sliding storage basket assembly 12 of the invention inside the cabinet enclosure, the assembly is positioned inside the enclosure with the track flanges 52 engaged in the rail slots 44 and with the aft ends of the rails 16 engaging against the aft stop abutments 56 of the tracks 18 as shown in FIG. 1. In this position of the assembly, the basket container 14 is positioned slightly behind the cabinet door 66 to prevent the door from contacting the container when closed. With the component parts of the assembly so assembled and positioned in the enclosure as shown in the drawing figures, the screw fasteners 62 are inserted between the crisscrossing pluralities of wires 32, 34 and into the holes 58 provided in the pair of tracks 18. Screwing down the fasteners 62 through the holes 58 and into the base 64 secures the tracks to the base in laterally spaced, parallel and longitudinally extending relative positions with the flanges 52 of each track 18 engaging in the slots 44 of the rails 16. Several of the holes 58 in the tracks 18 may be shielded by the top horizontal sections 36 of the rails and it may be necessary to slide the container 14 and attached rails 16 over the tracks 18 slightly to expose all the holes 58 in the tracks. When both tracks have been secured to the base by the screw threaded fasteners 62, the basket container 14 is ready for sliding fore and aft movement over the pair of tracks between its rearward most position shown in FIG. 1, and its forward most position shown in FIG. 2.

In the position of the basket container 14 shown in FIG. 1, the aft ends 68 of the pair of rails 16 engage the aft stops 56 of the pair of tracks 18 and further rearward movement of the basket container 14 over the tracks is prevented. In the position of the basket container 14 shown in FIG. 2, the fore ends 72 of the pair of rails 16 engage against the fore stops 54 of the tracks and further forward movement of the basket container 14 over the tracks is prevented. In the forward position of the basket container 14, it can be seen that slightly more than half of the basket container extends beyond the forward edge of the tracks 18 and the front opening of the cabinet enclosure. This positioning of the basket container provides easy access to all areas of the basket container interior. In the same manner, when the sliding storage basket assembly 12 is employed on a shelf, sliding the basket container 14 forward on the tracks 18 extends slightly more than half of the basket container beyond the forward most edge of the tracks and shelf and provides easy access to all areas of the container interior.

Should it be desired to remove the basket container 14 from its sliding engagement with the pair of tracks 18, the vertical width of the slots 44 formed in the rails permits the rails to be elevated slightly relative to the track flanges 52 and the fore stops 54 of the tracks. By pulling upward on the basket container 14 and then pulling the container forward, the C-shaped sections 42 of the rails are elevated relative to the track flanges 52 and fore stops 54 and the slots 44 slide forward over the track fore stops 54 to separate the container 14 from the pair of tracks 18.

The procedure for reattaching the basket container 14 to the pair of tracks 18 is substantially the same. The basket container and the attached pair of rails 16 are elevated slightly relative to the track fore stop abutments 54 and the rail slots 44 are then slipped over the fore stops 54 to reattach the pair of rails in sliding engagement over the pair of tracks.

As is best seen in FIG. 2, the particular configuration and relative positioning of the component parts of the invention provide a safety feature that prevents the inadvertent disengagement of the basket container 14 from the pair of tracks 18. As the basket container is moved forward over the pair of tracks, the weight at the forward end of the basket container, shown to the left in FIG. 2, forces that end of the container and the fore ends 72 of the rails downward. This causes the fore ends 72 of the rails to slide across the top surfaces of the track flanges 52 and engage the fore stop abutments 54 of the tracks when the rails reach the forward most ends of the tracks. In order to disengage the pair of rails from the pair of tracks, the forward most end of the basket container 14 must be deliberately elevated in order to elevate the fore rail ends 72 over the fore abutment stops 54 of the tracks.

A further embodiment of the sliding storage basket assembly of the invention is shown in FIGS. 6–9 of the drawing figures. Like the first described embodiment, this embodiment is also generally comprised of a wire basket container 82, a pair of rails 84 secured to the underside of the basket container, and a pair of tracks 86 that slidingly engage with the rails and are mounted on a horizontal base surface 88.

The wire basket container 82 includes a rectangular peripheral wire loop 92 at the top of the container. A plurality of wires 94 extend vertically downward from the opposite left and right sides of the wire loop 92, and then extend horizontally across the bottom of the basket container. A second plurality of wires 96 extend vertically downward from the front and back of the wire loop, and then extend horizontally across the bottom of the basket container. The first and second pluralities of wires crisscross each other and are secured together at the bottom of the basket container. Together, the first and second pluralities of wires form the container basket bottom.

Figure 8:
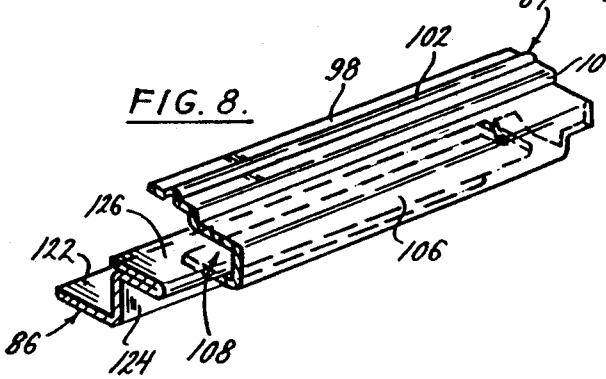
FIG. 8 is a segmented perspective view of one track and one rail of the further embodiment of the sliding storage basket assembly of the invention.

The pair of rails 84 secured to the underside of the basket container bottom are substantially identical mirror images of each other. As is best seen in FIG. 8, each rail 84 is formed with a substantially flat horizontal top section 98 that extends the entire longitudinal length of the rail. A weld bead 102 extends longitudinally across the middle of each rail top section 98. The weld bead 102 is secured to the underside of the crisscrossing pluralities of wires 94, 96 that form the basket container bottom by welds at each point the weld bead 102 contacts one of the crisscrossing pluralities of wires. Each of the rails also includes a vertical section 104 that depends downward from a lateral edge of the top section 98. The vertical section also extends along the entire longitudinal length of the rail. At the bottom most edge of the vertical section 104, the rail is formed in a C-shaped section 106. The interior of the C-shaped section 106 forms a slot 108 that extends the entire longitudinal length of the rail 84.

Figure 6:
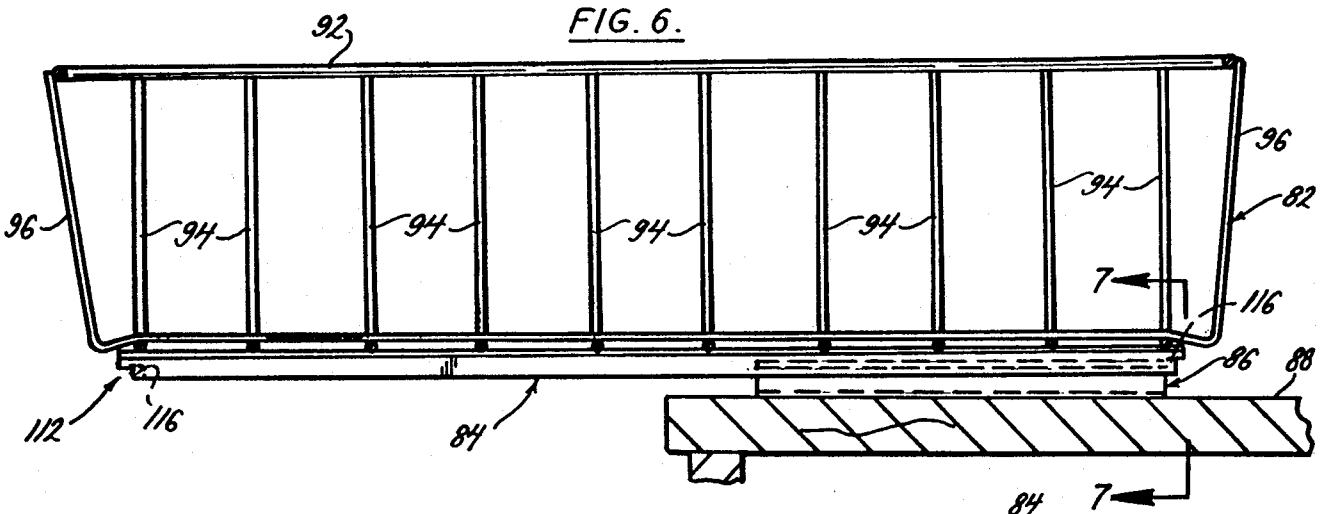
FIG. 6 is an elevation view of a further embodiment of the sliding storage basket assembly of the invention mounted on a storage shelf.

As seen in FIG. 6, the longitudinal length of the rails 84 in this embodiment of the invention is substantially the same longitudinal length of the basket container 82. This enables slightly more than half of the basket container 82 to extend beyond the forward most ends of the tracks 86 when the basket is moved its furthest extent forward on the tracks. Like the first embodiment of the invention, the pair of rails 84 are secured to the underside of the basket container 92 in a laterally spaced relation. The rails extend parallel and longitudinally across the bottom of the basket container with the slots 86 of the rails facing each other. Alternatively, the rails could be secured to the bottom of the basket container with the slots 86 facing away from each other (not shown). Of course, the positions of the tracks 86 will also have to be altered so that the flanges of the tracks engage in the slots of the rails.

Figure 9:
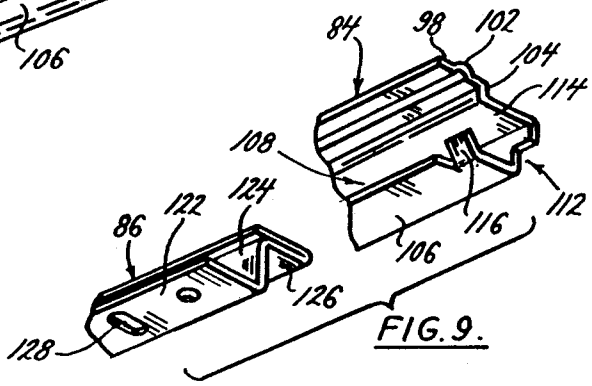
FIG. 9 is a segmented perspective view showing the detail of the rail stop abutment of the further embodiment of the sliding storage basket of the invention.

As is best seen in FIG. 9, at the opposite ends of the rails 84 the lower half of the C-shaped section 106 is cut away, leaving a small notch 112 at the opposite ends of the rails. The notches 112 cut in the opposite ends of the rails 84 expose a small portion of the interior surface 114 at the top of the rail C-shaped section 106. The exposed interior surface 114 facilitates the mounting of the pair of rails 84 on the pair of tracks 86 as will be later explained.

Adjacent the notches 112 at the opposite ends of the rails 108, the bottom of the rail C-shaped sections 106 are cut to form tabs 116. The tabs are bent upward into the slots 108 formed by the C-shaped sections 106. The tabs 116 form the fore and aft stop abutments at the opposite ends of the rails 84 in this embodiment of the invention. The fore and aft stop abutments 116 limit the sliding movement of the rails 84 over the tracks 86 in a manner to be described.

The pair of tracks 86 are also substantially identical to each other. One track 86 of the pair of tracks is shown in FIG. 8 inserted into the slot 108 of one rail 84 of the pair of rails. As seen in FIG. 8, each track is formed with a bottom horizontal section 122 that extends the entire longitudinal length of the track. A vertical section 124 extends upward from a lateral side edge of the bottom section 122. The vertical section also extends the entire longitudinal length of the track. A flange section 126 is formed along the top most edge of the vertical section 124. The flange section is formed by folding the top half of the track over on itself as seen in FIG. 8. The flange section 126 projects laterally from the top edge of the vertical section 124 and extends the entire longitudinal length of the track. Pluralities of holes 128 are provided through the bottom horizontal sections 122 of the tracks. The holes receive threaded fasteners such as wood screws 132 or other equivalent types of fasteners to secure the pair of tracks 86 to a flat horizontal base surface 88.

The embodiment of the sliding storage basket assembly shown in FIGS. 6–9 is mounted to a flat horizontal base surface 88 in substantially the same manner as the previously described embodiment of the invention. Drawing FIGS. 6–9 show the assembly of the invention mounted on a top surface of a storage shelf 88. The apparatus of the invention is shown in this environment for illustrative purposes only and it should be understood that the operative environment of the invention described is not intended to be limiting.

The second embodiment of the invention differs from the first described embodiment primarily in that the longitudinal length of the pair of rails 84 is over twice as long as the longitudinal length of the pair of tracks 86, and the fore and aft stop abutments 116 of the assembly are provided on the fore and aft ends of the pair of rails 84 and not on the pair of tracks 86.

Figure 7:
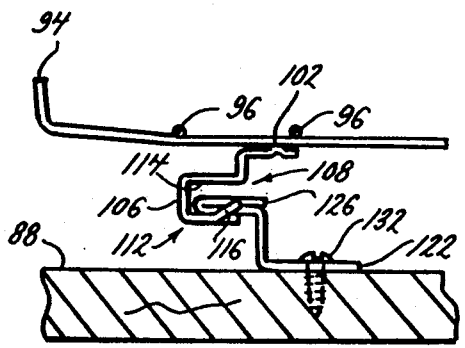
FIG. 7 is a segmented front elevation view of the further embodiment of the sliding storage basket assembly taken along the line 7—7 of FIG. 6.

Referring to drawing FIG. 7, it can be seen that the vertical dimensions of the rail slots 108 enable limited vertical movement of the container basket 82 and rails 84 relative to the tracks 86. The vertical dimensions of the rail slots 108 also enable the container basket 82 and rails 84 to pivot slightly relative to the pair of tracks 86 when the basket is pulled out to its furthest extent or pushed back to its furthest extent on the pair of tracks. FIG. 6 shows the container basket 82 pulled out to its furthest extent on the pair of rails 86. As the basket is being pulled forward on the rails, the weight of the basket and any objects it contains cause the forward end, or left end of the basket as viewed in FIG. 6, to move slightly downward, causing the container basket 82 to pivot slightly on the pair of tracks 86. The downward movement of the container basket front end causes the rearward or right hand end of the container basket and rails to move slightly upward relative to the tracks. The upward pivoting movement of the rearward end of the container basket 82 and rails 84 causes the stop abutments 116 at the bottoms of the rail C-shaped sections 106 to move upward relative to the tracks 86. This causes the stop abutments 116 to engage against the aft ends of the tracks 86 as the container basket 82 is pulled forward as shown in FIG. 7.

This same pivoting movement of the container basket 82 and rails 84 on the pair of tracks 86 occurs when the basket is pushed backward over the tracks. As the basket and rails are pushed backward over the pair of tracks 86, the weight of the basket and any objects it contains cause the rearward end, or right hand end of the basket as viewed in FIG. 6 to move slightly downward. The downward movement of the rearward end of the basket causes the basket to pivot slightly on the pair of tracks 86. The pivoting of the basket causes the forward end, or left hand end of the basket and rails as viewed in FIG. 6, to move slightly upward. This causes the fore stop abutments 116 of the container basket rails 84 to move upward relative to the pair of tracks 86 and engage against the fore ends of the pair of tracks and stop the rearward sliding movement of the basket over the tracks.

To remove the container basket 82 from the pair of tracks 86, the container basket is held level relative to the pair of tracks as it is moved forward over the tracks. This prevents the pivoting movement of the basket relative to the tracks and also prevents the movement of the aft stop abutments 116 of the rails upward where they would engage against the aft ends of the tracks. Holding the basket level in the pair of tracks 86 causes the rail aft stops 116 to slide underneath the aft ends of the rails 86, thereby enabling removal of the container basket 82 from the pair of tracks 86.

Reattaching the container basket 82 to the pair of tracks 86 is substantially the same as removing the basket from the pair of tracks. Again, the basket is held level relative to the tracks 86 as the pair of rails 84 are attached on the forward ends of the tracks. The notches 112 cut out from the forward ends of the pair of rails 84 enable the exposed interior surfaces 114 of the rail C-shaped sections 106 to be first placed on top of the forward most ends of the track horizontal flange sections 126. With the exposed interior surfaces 114 of the rail slots supported on the top surfaces of the track flanges 126, and with the container basket 82 and attached rails 84 held level relative to the pair of tracks 86, the container basket assembly is now pushed backward so that the C-shaped rail sections 106 slide over the track flanges 126.

Although both embodiments of the invention have been described and shown in the drawing figures with the slots 44, 108 of the rail C-shaped sections facing inward toward each other, and the flanges 52, 126 of the pair of tracks facing away from each other, it should be understood that the relative positions of these component parts of the invention could be reversed without effecting the operation of the invention. For example, the pair of rails could be mounted to the underside of the container basket with the C-shaped sections of the rails facing away from each other. To accommodate this positioning of the rails, the pair of tracks would then be mounted to the horizontal base surface with the flanges of the tracks positioned facing toward each other and engaging in the oppositely facing slots of the pair of rails.

While the present invention has been described by reference to a specific embodiment, it should be understood that modifications and variations of the invention may be constructed without departing from the scope of the invention defined in the following claims.

What is claimed is:

1. A sliding storage container apparatus mountable on a base and slidable longitudinally fore and aft relative to the base, the apparatus comprising:

containment means for containing objects to be stored;

first sliding support means for being secured to an underside of the containment means and extending longitudinally beneath the containment means;

second sliding support means for being secured to the base extending longitudinally over the base, the second sliding support means overlapping and engaging a lateral side of the first sliding support means to mount the first sliding support means for sliding movement on the second sliding support means and thereby mount the containment means for sliding movement on the base;

the first sliding support means includes at least one rail secured to the underside of the containment means, the rail having a longitudinally extending slot therein;

the second sliding support means includes at least one track to be secured to the base, the track having a laterally extending flange thereon that engages in the slot of the first sliding support means; and the rail has opposite fore and aft ends and fore and aft stops secured on the fore and aft ends of the rail, respectively, the fore and aft stops limit sliding movement of the first sliding support means on the second sliding support means.

2. The container apparatus of claim 1, wherein:

the track has opposite fore and aft ends, the fore end of the track engages the fore stop of the rail to limit rearward sliding movement of the containment means on the base, and the aft end of the track engages the aft stop of the rail to limit forward sliding movement of the containment means on the base.

3. The container apparatus of claim 1, wherein:

the first sliding support means is secured stationary relative to the containment means and the second sliding support means is secured stationary relative to the base.

4. The container apparatus of claim 1, wherein:

the first sliding support means includes a pair of separate, laterally spaced rails, each rail having a longitudinally extending slot therein; and the second sliding support means includes a pair of separate, laterally spaced tracks, each track having a flange thereon.

5. A sliding storage container apparatus mountable on a base and slidable longitudinally fore and aft relative to the base, the apparatus comprising:

a container having a bottom;

a pair of separate, laterally spaced rails secured to an underside of the container bottom, the rails extending longitudinally across the container bottom, each rail having opposite fore and aft ends and a length between the fore and aft ends defining a first distance;

a pair of separate, laterally spaced tracks to be secured to the base, the tracks extending longitudinally across the base, each track having opposite fore and aft ends and a length between the fore and aft ends defining a second distance, each track of the pair of tracks overlapping and engaging a lateral side of one rail of the pair of rails to mount the rails for sliding movement on the tracks and thereby mount the container for sliding movement on the base;

each of the rails of the pair of rails is provided with a slot formed therein each slot extends a longitudinal distance in the rail equal to the first distance;

each track of the pair of tracks is provided with a laterally extending flange formed thereon, each flange extends a longitudinal distance on the track equal to the second distance, and each flange engages in the slot in each rail to mount the pair of rails for sliding movement on the pair of tracks; and, each rail of the pair of rails has opposite fore and aft ends and fore and aft stops secured on the fore and aft ends of the rail, respectively, the fore and aft stops limit sliding movement of the pair of rails on the pair of tracks.

6. The container apparatus of claim 5, wherein:

the pair of rails are secured stationary relative to the bottom of the container and the pair of tracks are secured stationary relative to the base.

7. The container apparatus of claim 5, wherein:

the second distance is longer than the first distance.

8. The container apparatus of claim 5, wherein:

the second distance is shorter than the first distance.

9. The container apparatus of claim 5, wherein:

each track of the pair of tracks is provided with a laterally extending flange formed thereon, each flange extends a longitudinal distance on the track equal to the second distance.

10. The container apparatus of claim 5, wherein:

each track of the pair of tracks has opposite fore and aft ends, the fore ends of the tracks engage the fore stops of the rails to limit rearward sliding movement of the container on the base, and the aft ends of the tracks engage the aft stops of the rails to limit forward sliding movement of the container on the base.

11. The container apparatus of claim 5, wherein:

each slot in the pair of rails has a width dimension that enables the pair of rails to be elevated slightly relative to the flanges on the pair of tracks, and the fore and aft ends of the rails do not engage the fore and aft stops of the tracks when the rails are elevated relative to the tracks.

* * * * *